US009637305B2

(12) United States Patent
Fredette et al.

(10) Patent No.: US 9,637,305 B2
(45) Date of Patent: May 2, 2017

(54) CONTAINER SYSTEM WITH INTERLOCK AND COLLAPSIBLE CAPABILITIES

(71) Applicants: David Fredette, East Moriches, NY (US); Thomas Fredette, New York, NY (US)

(72) Inventors: David Fredette, East Moriches, NY (US); Thomas Fredette, New York, NY (US)

( * ) Notice: Subject to any disclaimer, the term of this patent is extended or adjusted under 35 U.S.C. 154(b) by 12 days.

(21) Appl. No.: 14/132,231

(22) Filed: Dec. 18, 2013

(65) Prior Publication Data

US 2014/0103035 A1 Apr. 17, 2014

Related U.S. Application Data

(62) Division of application No. 13/550,329, filed on Jul. 16, 2012, now abandoned.
(Continued)

(51) Int. Cl.
*B65D 1/30* (2006.01)
*B65D 21/028* (2006.01)
(Continued)

(52) U.S. Cl.
CPC ..... *B65D 88/027* (2013.01); *B65D 9/06* (2013.01); *B65D 19/02* (2013.01); *B65D 21/0204* (2013.01); *B65D 88/522* (2013.01); *B65D 90/12* (2013.01); *B65D 2519/00019* (2013.01); *B65D 2519/00024* (2013.01); *B65D 2519/00029* (2013.01); *B65D 2519/00034* (2013.01); *B65D 2519/00054* (2013.01); *B65D 2519/00059* (2013.01); *B65D 2519/00064* (2013.01); *B65D 2519/00069* (2013.01);
(Continued)

(58) Field of Classification Search
CPC ... B65D 1/30; B65D 90/0006; B65D 21/0209
USPC ..... 220/4.26, 4.27, 23.4, 23.6, 23.8, 23.2, 220/23.83; 206/504, 144
See application file for complete search history.

(56) References Cited

U.S. PATENT DOCUMENTS 641,245 A 1/1900 Sugg
1,655,342 A 1/1928 Spears
(Continued)

FOREIGN PATENT DOCUMENTS

| | | |
|---|---|---|
| DE | 195 17 460 | 11/1996 |
| EP | 0 771 735 | 5/1997 |
| WO | WO 03055756 | 7/2003 |

OTHER PUBLICATIONS

European Search Report, Application No. EP 06 81 4279, dated Oct. 8, 2008.

*Primary Examiner* — J. Gregory Pickett
*Assistant Examiner* — Allan Stevens
(74) *Attorney, Agent, or Firm* — Carter, DeLuca, Farrell & Schmidt, LLP; Joseph W. Schmidt

(57) ABSTRACT

A container system for use with a forklift, includes a plurality of containers, each container including side and end walls and having interlocking structure cooperatively arranged whereby adjacent containers are connectable to each other and a base secured relative to each container. The base is dimensioned to support the container and being adapted to couple with the blade of the forklift to permit placement and transport of the containers in an interlocked relation thereof. Each container may be collapsible to facilitate storage thereof.

5 Claims, 18 Drawing Sheets

Related U.S. Application Data

(60) Provisional application No. 61/507,660, filed on Jul. 14, 2011.

(51) Int. Cl.

| | |
|---|---|
| ***B65D 88/02*** | (2006.01) |
| ***B65D 19/02*** | (2006.01) |
| ***B65D 21/02*** | (2006.01) |
| ***B65D 6/02*** | (2006.01) |
| ***B65D 88/52*** | (2006.01) |
| ***B65D 90/12*** | (2006.01) |

(52) U.S. Cl.

CPC ..... *B65D 2519/0096* (2013.01); *B65D 2519/00159* (2013.01); *B65D 2519/00164* (2013.01); *B65D 2519/00169* (2013.01); *B65D 2519/00174* (2013.01); *B65D 2519/00194* (2013.01); *B65D 2519/00199* (2013.01); *B65D 2519/00203* (2013.01); *B65D 2519/00208* (2013.01); *B65D 2519/00318* (2013.01); *B65D 2519/00323* (2013.01); *B65D 2519/00338* (2013.01); *B65D 2519/00343* (2013.01); *B65D 2519/00497* (2013.01); *B65D 2519/00597* (2013.01); *B65D 2519/00621* (2013.01); *B65D 2519/00666* (2013.01); *B65D 2519/00711* (2013.01); *B65D 2519/00746* (2013.01); *B65D 2519/00915* (2013.01); *B65D 2519/00965* (2013.01); *B65D 2519/00975* (2013.01)

(56) References Cited

U.S. PATENT DOCUMENTS

| | | | | |
|---|---|---|---|---|
| 2,064,518 | A | | 12/1936 | Brogden |
| 2,338,604 | A | | 1/1944 | Silveyra |
| 2,468,231 | A | | 4/1949 | Prati |
| 2,807,387 | A | | 9/1957 | Siciliano |
| 2,919,875 | A | | 1/1960 | Mendel |
| 3,084,830 | A | | 4/1963 | Koelsch |
| 3,131,829 | A | | 5/1964 | Masser |
| 3,194,426 | A | | 7/1965 | Brown, Jr. |
| 3,266,656 | A | | 8/1966 | Kridle |
| 3,307,729 | A | * | 3/1967 | Schwartz ..... 220/890 |
| 3,341,053 | A | | 9/1967 | Keene |
| 3,650,224 | A | | 3/1972 | Petix et al. |
| 3,654,875 | A | * | 4/1972 | Vik ..... 108/53.1 |
| 3,707,127 | A | | 12/1972 | Palfey |
| 3,776,435 | A | | 12/1973 | Smith |
| 3,797,691 | A | | 3/1974 | Williams, Jr. |
| 3,857,342 | A | | 12/1974 | Johns |
| 4,022,257 | A | | 5/1977 | O'Connell |
| 4,098,398 | A | | 7/1978 | Meyers |
| 4,099,598 | A | | 7/1978 | Clinard |
| 4,403,692 | A | | 9/1983 | Pollacco |
| 4,470,647 | A | * | 9/1984 | Bishoff ..... F16B 5/07 312/108 |
| 4,823,947 | A | | 4/1989 | Maynard, Jr. |
| 4,889,254 | A | | 12/1989 | Vola |
| 4,966,298 | A | | 10/1990 | Von Holdt |
| 5,082,035 | A | | 1/1992 | Maxwell |
| 5,117,975 | A | * | 6/1992 | Kreps ..... 206/304 |
| 5,183,278 | A | * | 2/1993 | Wade, Jr. ..... B65F 1/004 206/504 |
| 5,271,515 | A | | 12/1993 | Berkheimer et al. |
| 5,375,703 | A | | 12/1994 | Deuber |
| 5,381,916 | A | | 1/1995 | Strawder |
| 5,402,903 | A | | 4/1995 | Mann |
| 5,447,245 | A | | 9/1995 | Merhar |
| 5,454,960 | A | | 10/1995 | Newsom |
| 5,503,288 | A | | 4/1996 | Conconi |
| 5,542,206 | A | | 8/1996 | Lisch |
| 5,881,692 | A | | 3/1999 | Lassanske |
| 6,276,550 | B1 | * | 8/2001 | Cherrington ..... 220/23.4 |
| 6,742,551 | B2 | | 6/2004 | Davis et al. |
| 6,907,703 | B2 | | 6/2005 | Gonzalez |
| 7,152,752 | B2 | | 12/2006 | Kurtenbach |
| 7,275,568 | B2 | | 10/2007 | Fredette et al. |
| 7,780,026 | B1 | | 8/2010 | Zuckerman |
| 8,261,782 | B2 | | 9/2012 | Fredette et al. |
| 2009/0090647 | A1 | | 4/2009 | Panchal et al. |

* cited by examiner

CONTAINER SYSTEM WITH INTERLOCK AND COLLAPSIBLE CAPABILITIES

CROSS-REFERENCE TO RELATED APPLICATIONS

This application is a divisional application of pending U.S. application Ser. No. 13/550,329, filed Jul. 16, 2012, which claims priority to and the benefit of U.S. Provisional Application Ser. No. 61/586,384, filed Jan. 13, 2012 and U.S. Provisional Application Ser. No. 61/507,660, filed Jul. 14, 2011, the entire contents of which are incorporated herein by reference.

BACKGROUND

1. Technical Field

The present invention is generally directed to container systems, and, in particular, is directed to a container system with an interlocking mechanism to secure the containers relative to each other during transport and storage. The present invention further relates to a self-palletizing container system which may be entirely collapsible.

2. Description of Related Art

Current package or container shipping systems require 1) containers or boxes for storing goods; 2) a palette upon which the containers are stacked; and 3) wrapping to maintain the containers together and on the palette during shipping. However, these known systems are deficient in a number of ways. For example, known container systems require separate paletting, incorporate excess wrapping material and are labor intensive with respect to storage and processing at job sites or warehouses.

SUMMARY

Accordingly, the present invention overcomes the deficiencies of known shipping systems by providing an interlocking-palletized-container system which eliminates much of the waste inherent in current systems. A container system for use with a forklift, includes a plurality of containers, each container including side and end walls and having interlocking structure cooperatively arranged whereby adjacent containers are connectable to each other and a base secured relative to each container. The base is dimensioned to support the container and is adapted to couple with the blade of the forklift to permit placement and transport of the containers in an interlocked relation thereof. Each container may include first and second bases connected to the container with respective pedestals, whereby the distance between the pedestals is at least equal to the width of the blade of the forklift such that a gap is defined therebetween for reception of the blade. Each container may include male and female runners with the male and female runners of adjacent containers cooperating to connect the adjacent containers. Each container may further include first and second end walls, and first and second side walls. The first end and side walls have the male runners and the second end and side walls have the female runners.

The interlocking structure may be dimensioned and arranged to directly couple three containers. In this embodiment, the interlocking structure may include a runner adjacent each corner of the container. Each runner has opposed rails and opposed grooves. The rail of a first container is cooperatively received within a groove of a second container to connect the first and second containers. A third container may have the interlocking structure, whereby the rails of the interlocking structure of the third container are received within a groove of the first container and the remaining groove of the third container.

In another aspect of the invention, each container is collapsible. Each container includes a collapsible frame operatively connected to the first and second end walls and the first and second side walls. Each collapsible frame includes vertical segments connected to the first and second end walls and the first and second side walls, and horizontal segments. The horizontal segments may be pivotally mounted relative to each other to permit movement of the horizontal segments between open and approximated conditions thereof. Adjacent end walls and side walls are adapted to fold upon relative to each other upon movement of the horizontal segments to the approximated condition.

BRIEF DESCRIPTION OF THE DRAWINGS

Preferred embodiments of the invention will be better appreciated by reference to the drawings wherein.

DETAILED DESCRIPTION OF THE EMBODIMENTS

Figure 1:
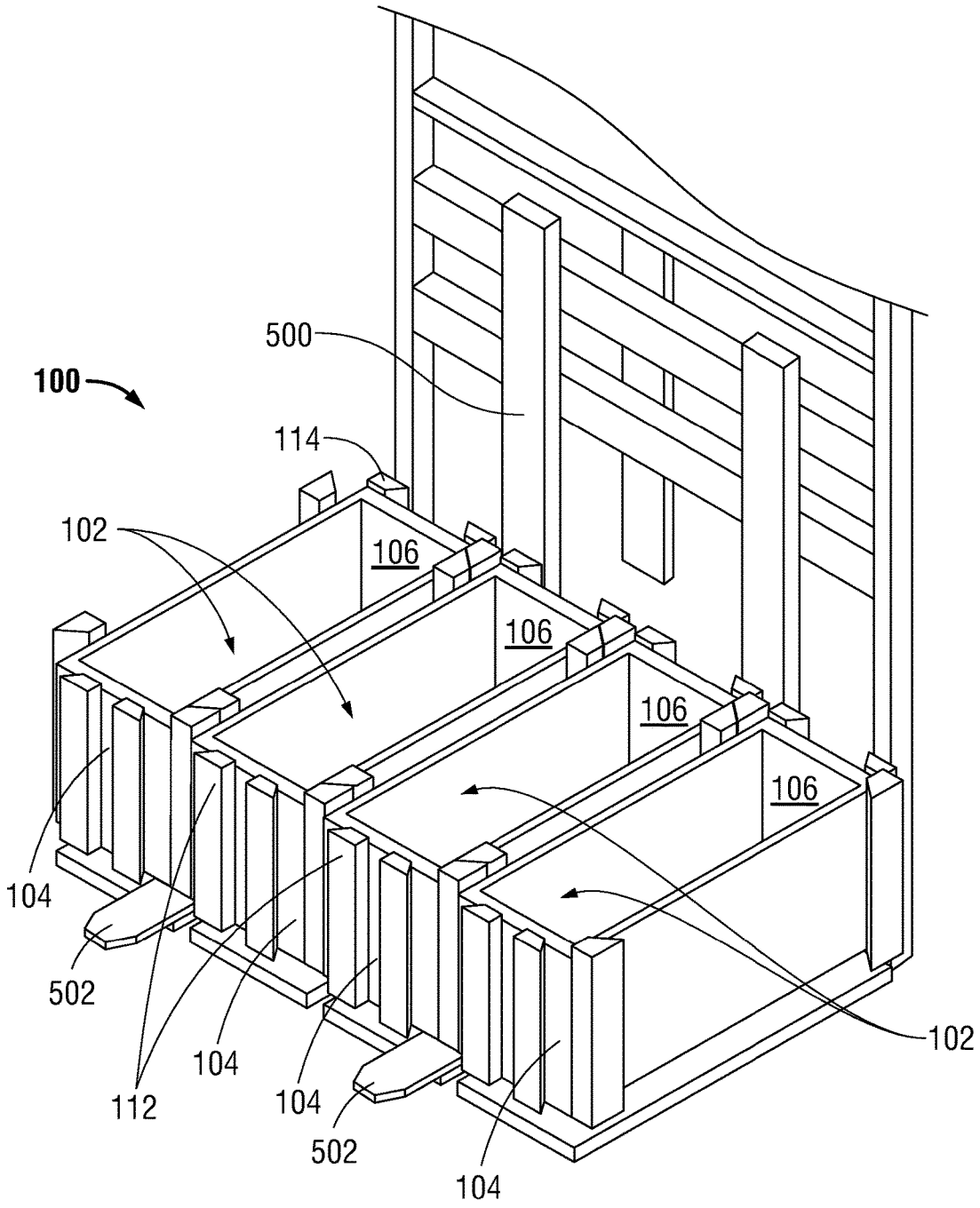
FIG. 1 is a first perspective view of the container system in accordance with the principles of the present disclosure and illustrated in transport via a forklift.
Figure 2:
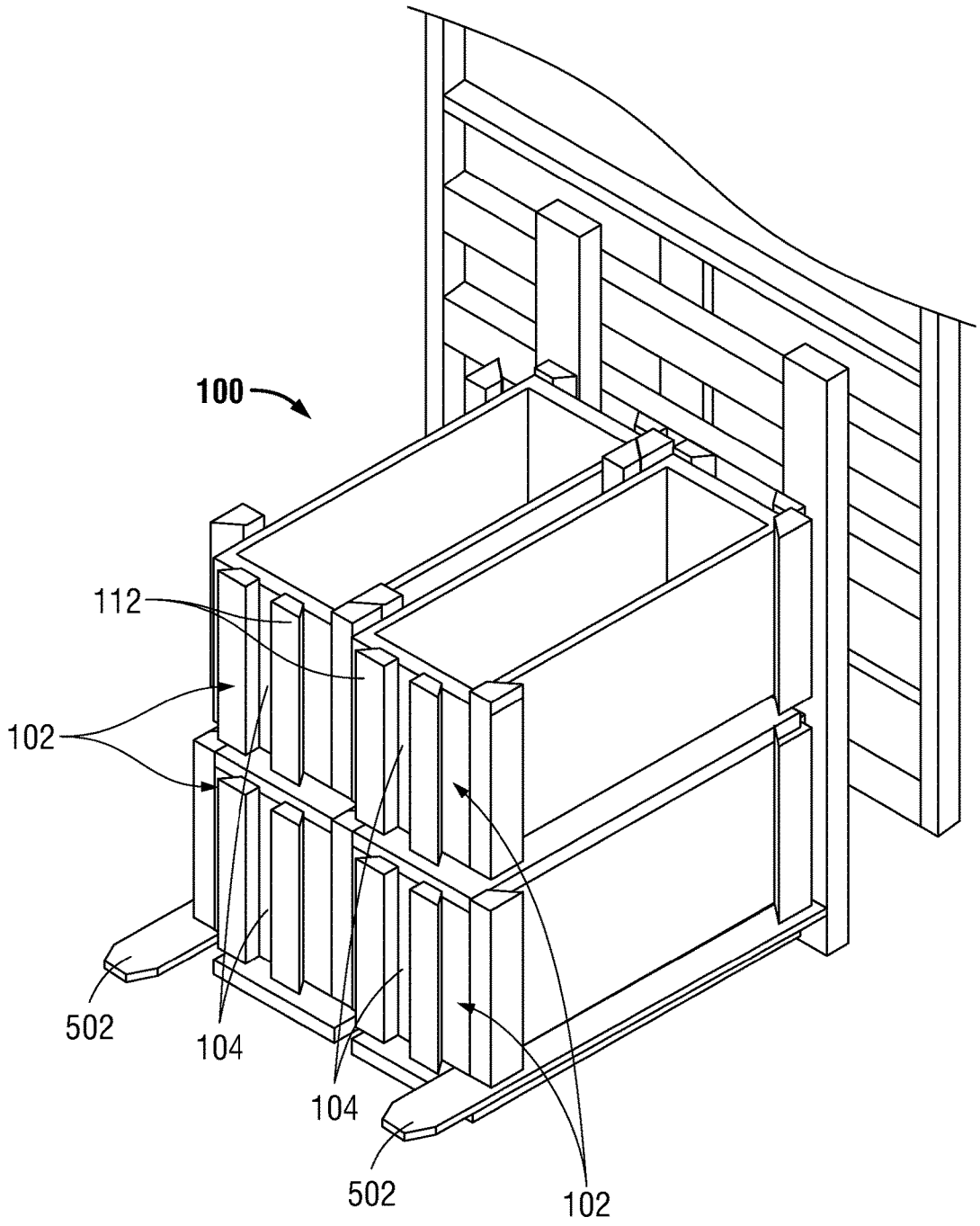
FIG. 2 is a second perspective view of the container system.
Figure 3:
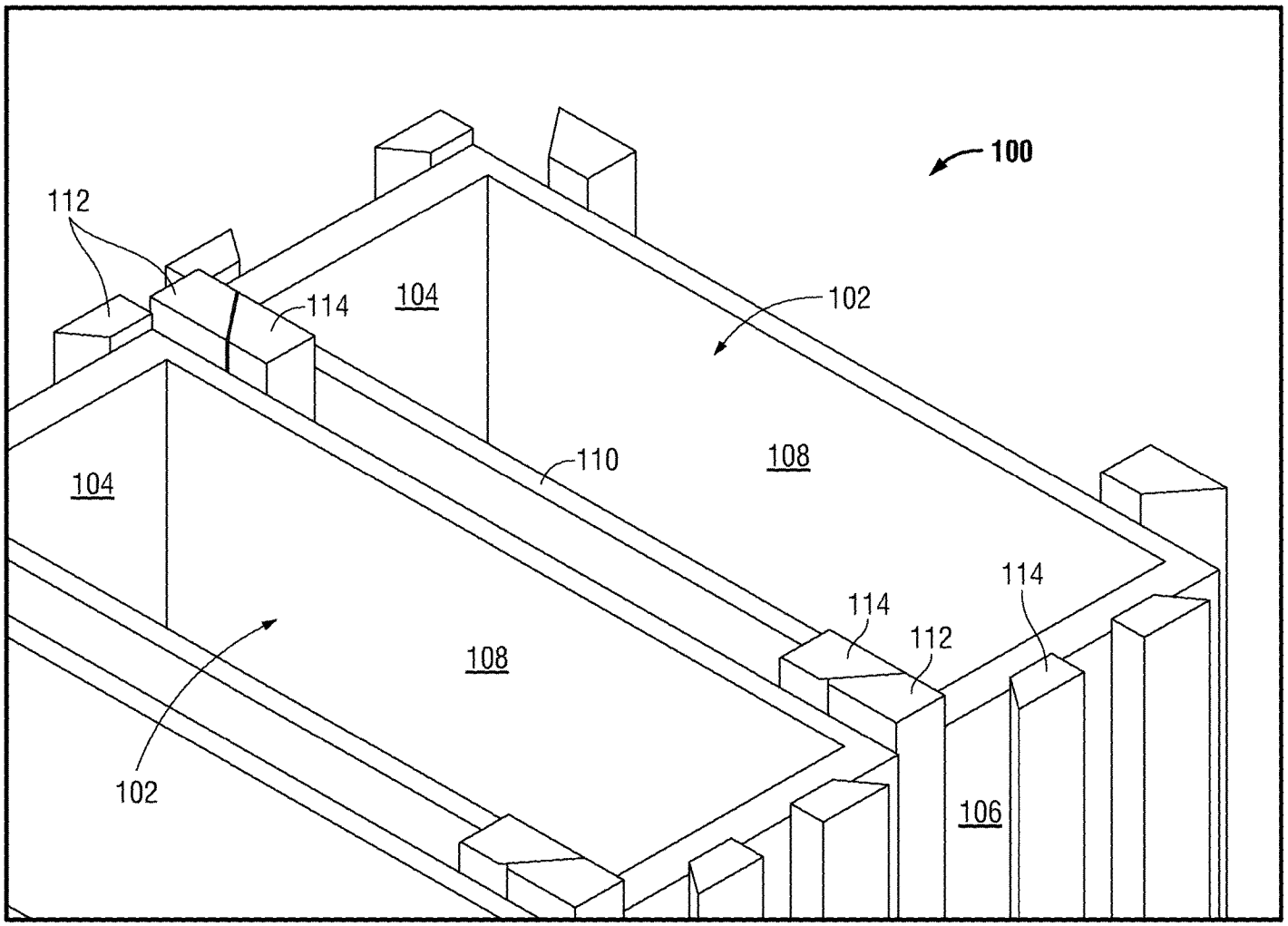
FIG. 3 is a partial perspective view illustrating the interlocking mechanism for interlocking adjacent containers of the container system.

Referring now to the drawings wherein like reference numerals illustrate identical or similar components throughout the description, the novel palletized container system 100 is illustrated. With initial reference to FIGS. 1 and 2, the container system 100 is shown assembled on a fork lift 500 having fork lift blades 502. The width of the fork lift blades 502 may range from about 2 to about 8 inches, usually around 4 inches. The container system 100 includes a plurality of containers 102 which may be interlocked for transport via, e.g., the forklift or the like. The containers 102 may be adapted for containing any goods which may be packaged within an enclosure, carton, dispenser or the like. The containers 102 include interlocking structure which permits selectable interlocking of a number of containers 102 in side by side or end to end relation. The containers also are self-palletized in that their use is independent of any need for a separate or individual pallet. FIG. 1 illustrates the containers 102 loaded on the fork lift 500 in side by side relation while FIG. 2 illustrates the containers 102 also loaded in vertical stacked relation.

Referring now to FIG. 3-6, one embodiment of the container 102 is illustrated. The container 102 may be any configuration including rectangular, square, hexagonal, octagonal etc. The container can be made out of plastic, metal, wood, cardboard among any other structural materials. In one embodiment, each container 102 is generally rectangular including first and second end walls 104, 106 and first and second side walls 108, 110. Each container 102 of the system includes interlocking structure. In one embodiment, the interlocking structure includes male and female runners 112, 114 on the end and side walls 104, 106, 108, 110, which interlock with corresponding male and female runners 112, 114 on an adjacent container 102 to effect an interlocked relation of the components. For example, the first side wall 108 may include outer or male runners 112 and the second side wall 110 include inner or female runners 114. Similarly, the first end wall 104 may include outer or male runners 112 and the second end wall 106 include inner or female runners 114. As illustrated, in this embodiment, the outer male runners 112 are adjacent to the corners of the container 102 while the inner female runners 114 are spaced a predetermined distance from the corner to cooperate with the male runner 112.

Figure 4:
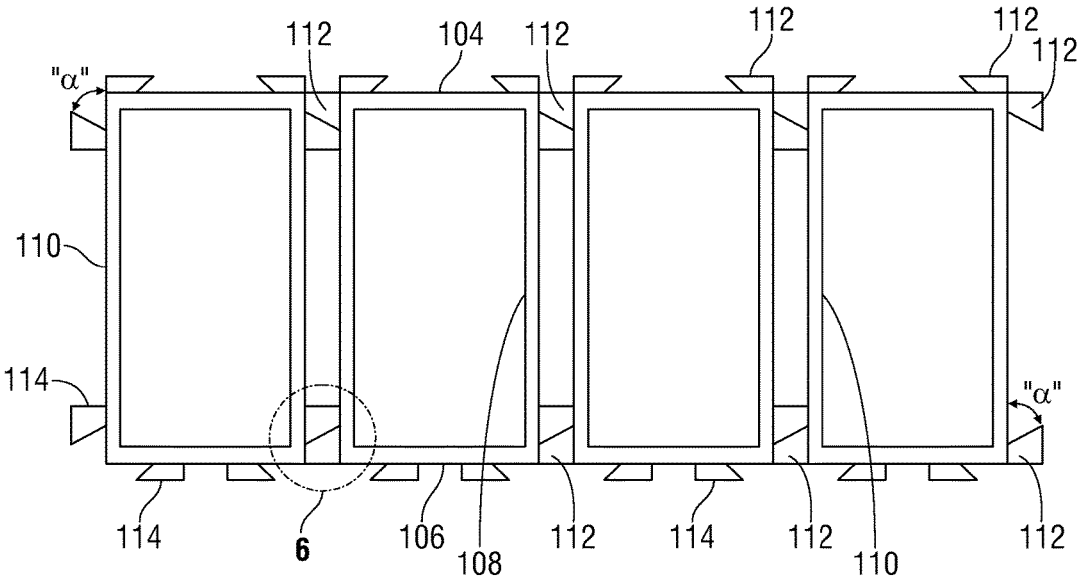
FIG. 4 is a top plan view illustrating a first arrangement of the containers of the container system.
Figure 5:
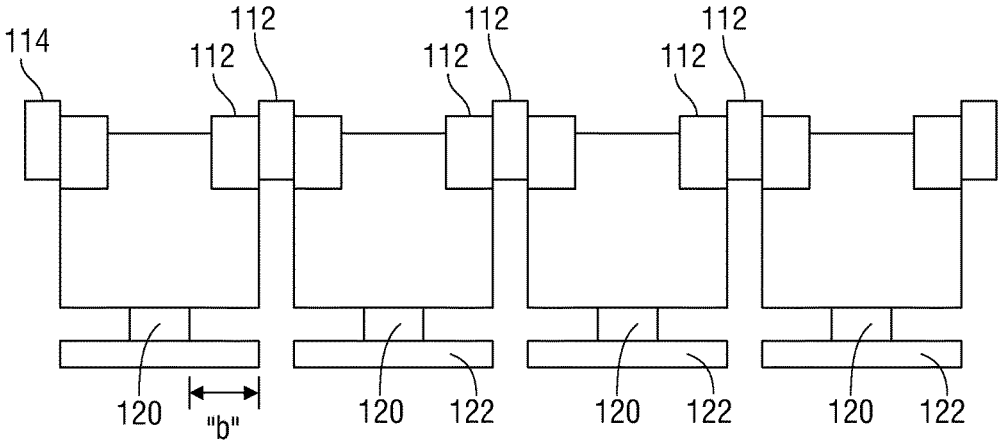
FIG. 5 is a side plan view of the first arrangement of the containers of FIG. 4.
Figure 6:
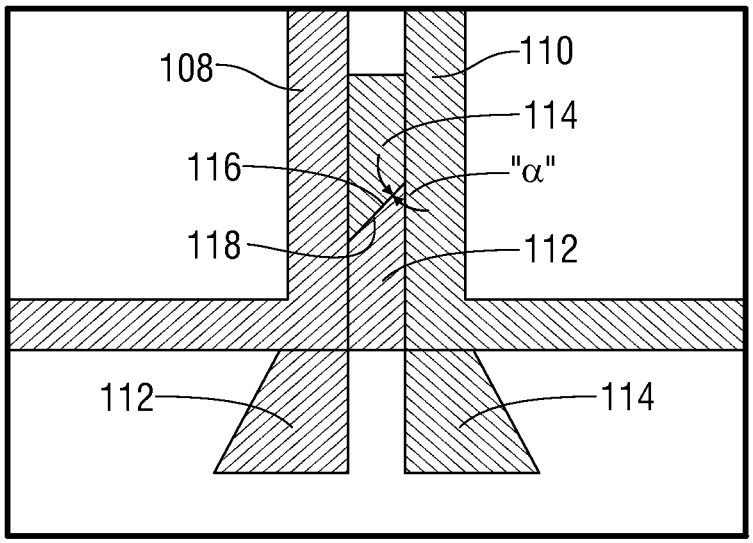
FIG. 6 is a cross-sectional view of the area of isolation identified in FIG. 5.
Figure 7:
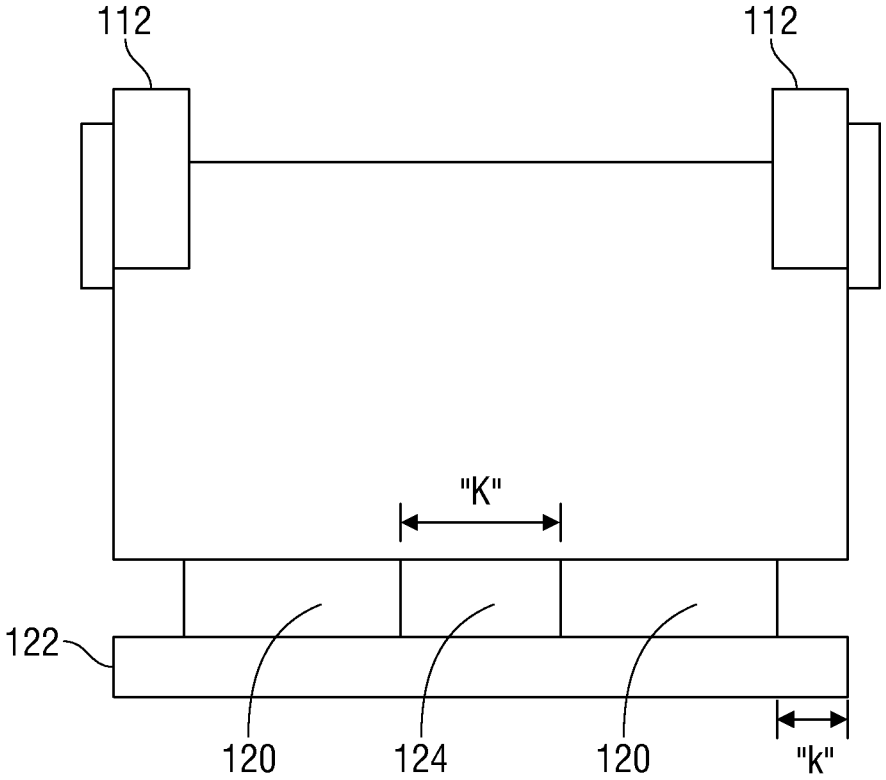
FIG. 7 is a side plan view of the first arrangement of the containers of FIGS. 4-6.
Figure 8:
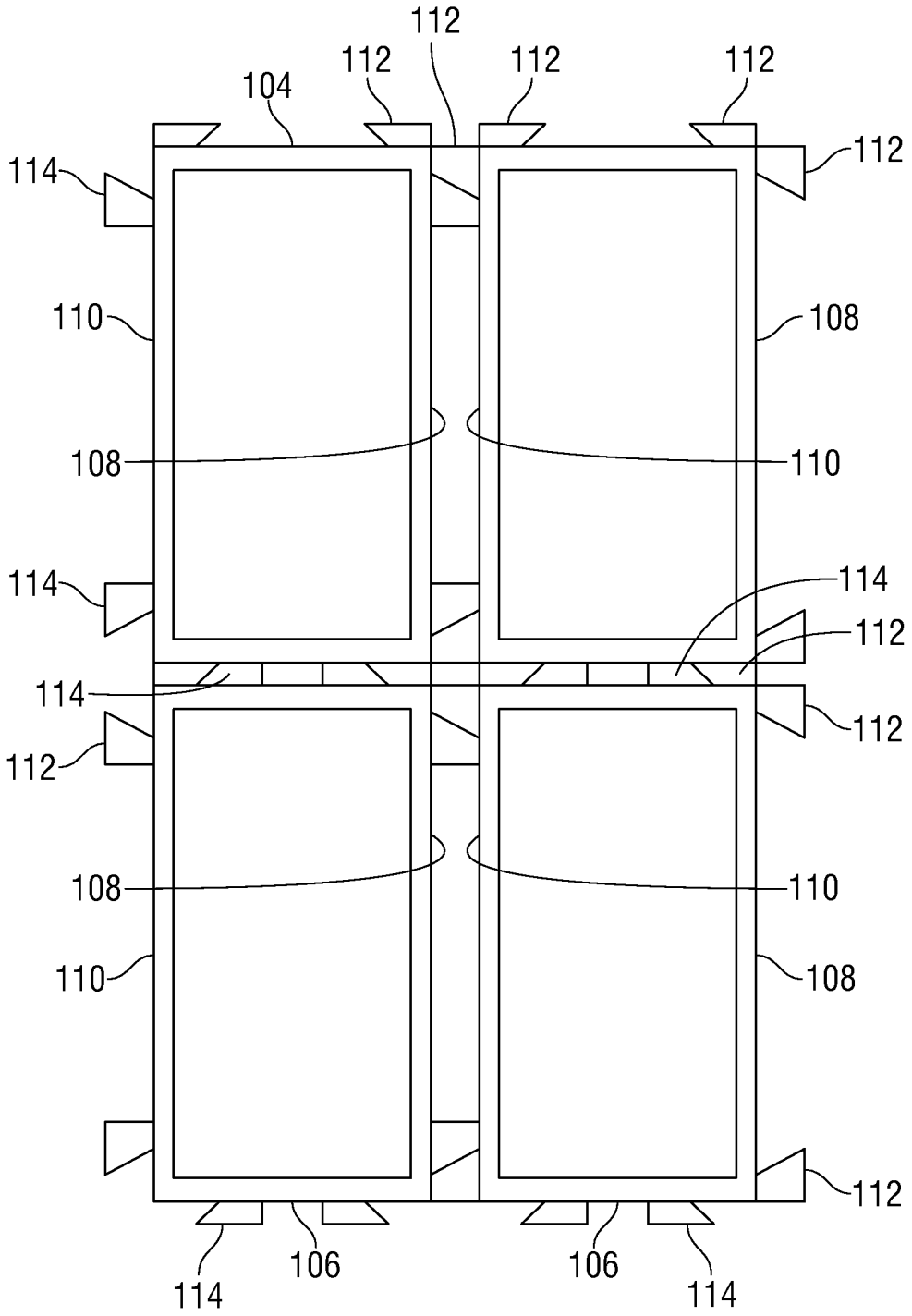
FIG. 8 is a top plan view illustrating a second arrangement of the containers of the container system.
Figure 9:
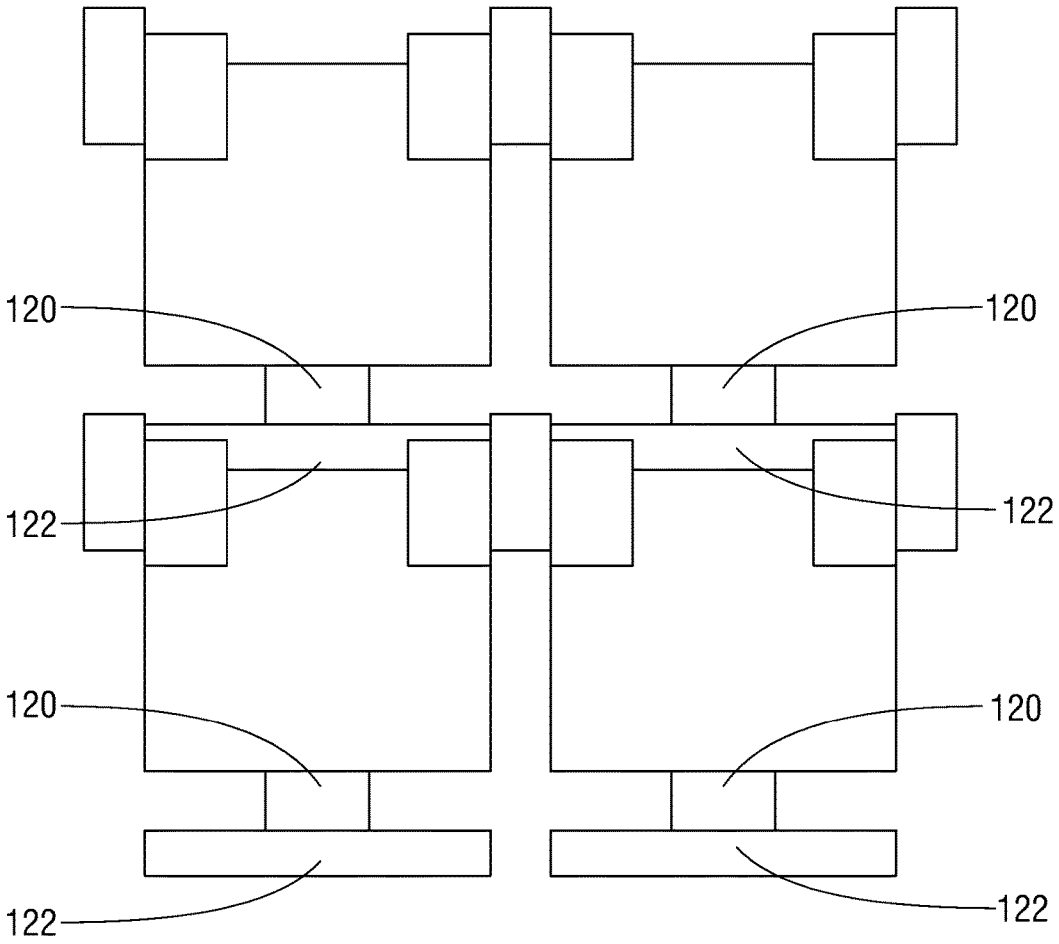
FIG. 9 is an end plan view of the containers of the second arrangement of FIG. 8.
Figure 10:
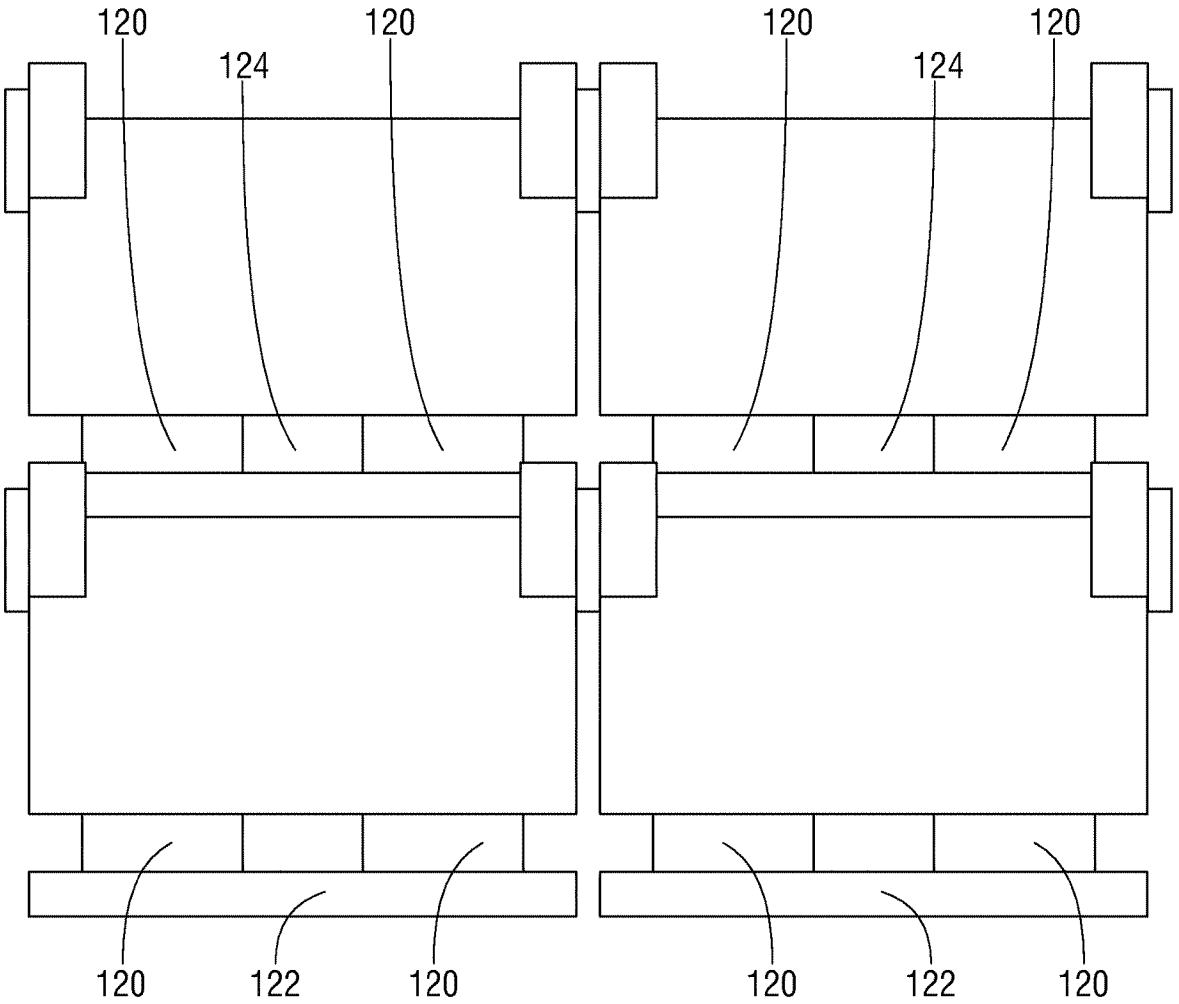
FIG. 10 is a side plan view of the containers of the second arrangement of FIGS. 8-9.
Figure 11:
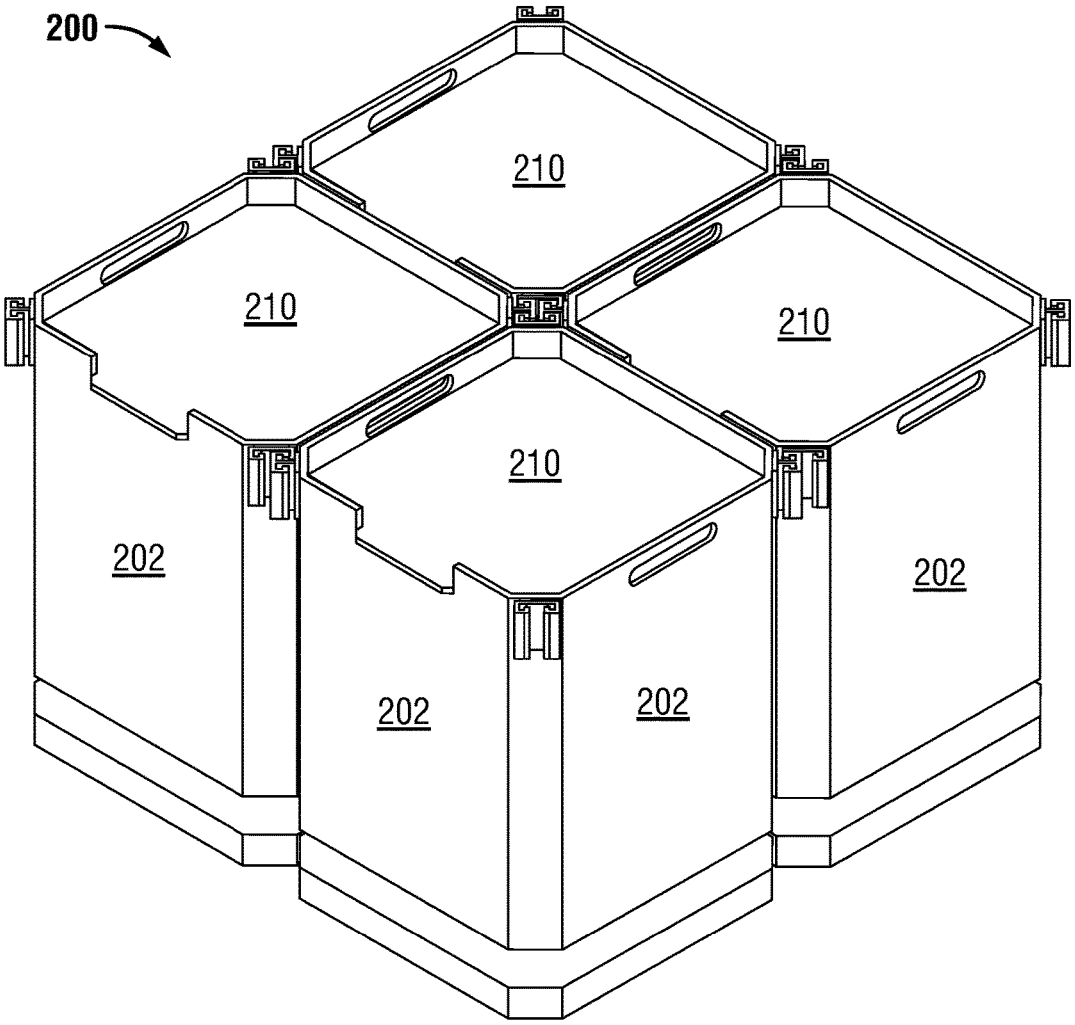
FIG. 11 is a perspective view of an alternate embodiment of the container system of FIG. 1.
Figure 12:
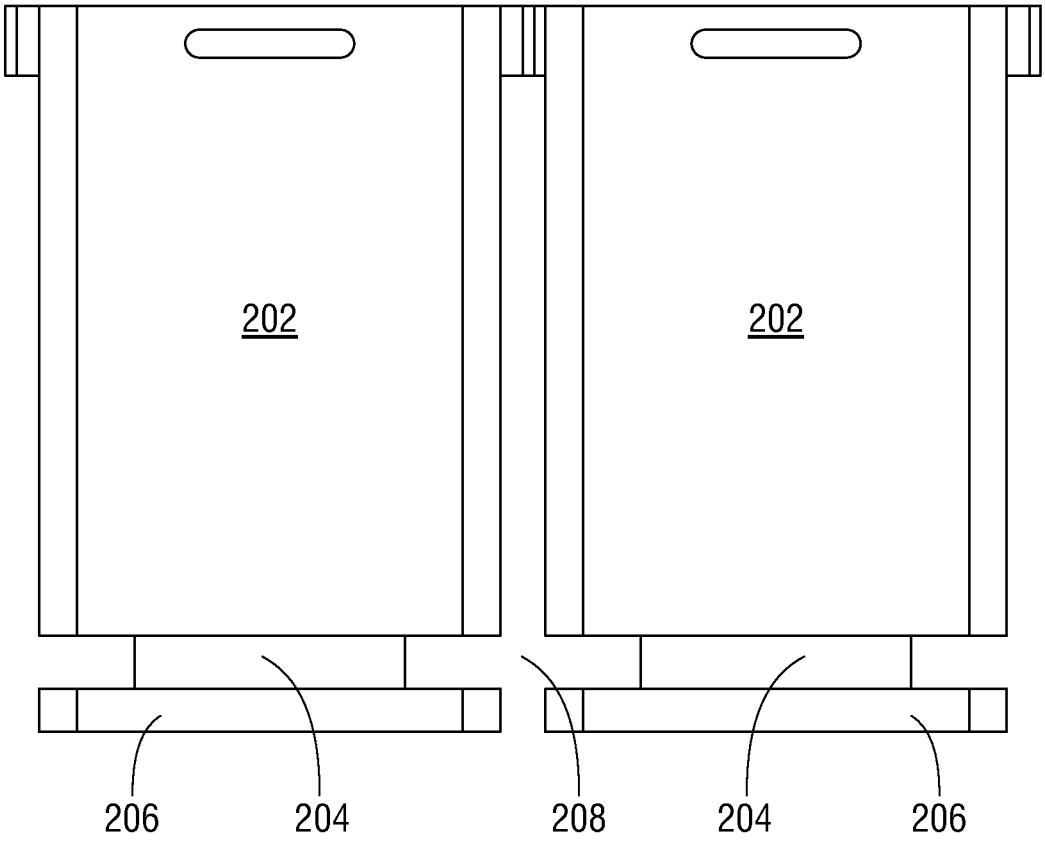
FIG. 12 is a side plan view of containers of the embodiment of FIG. 11 in interlocked relation.
Figure 13:
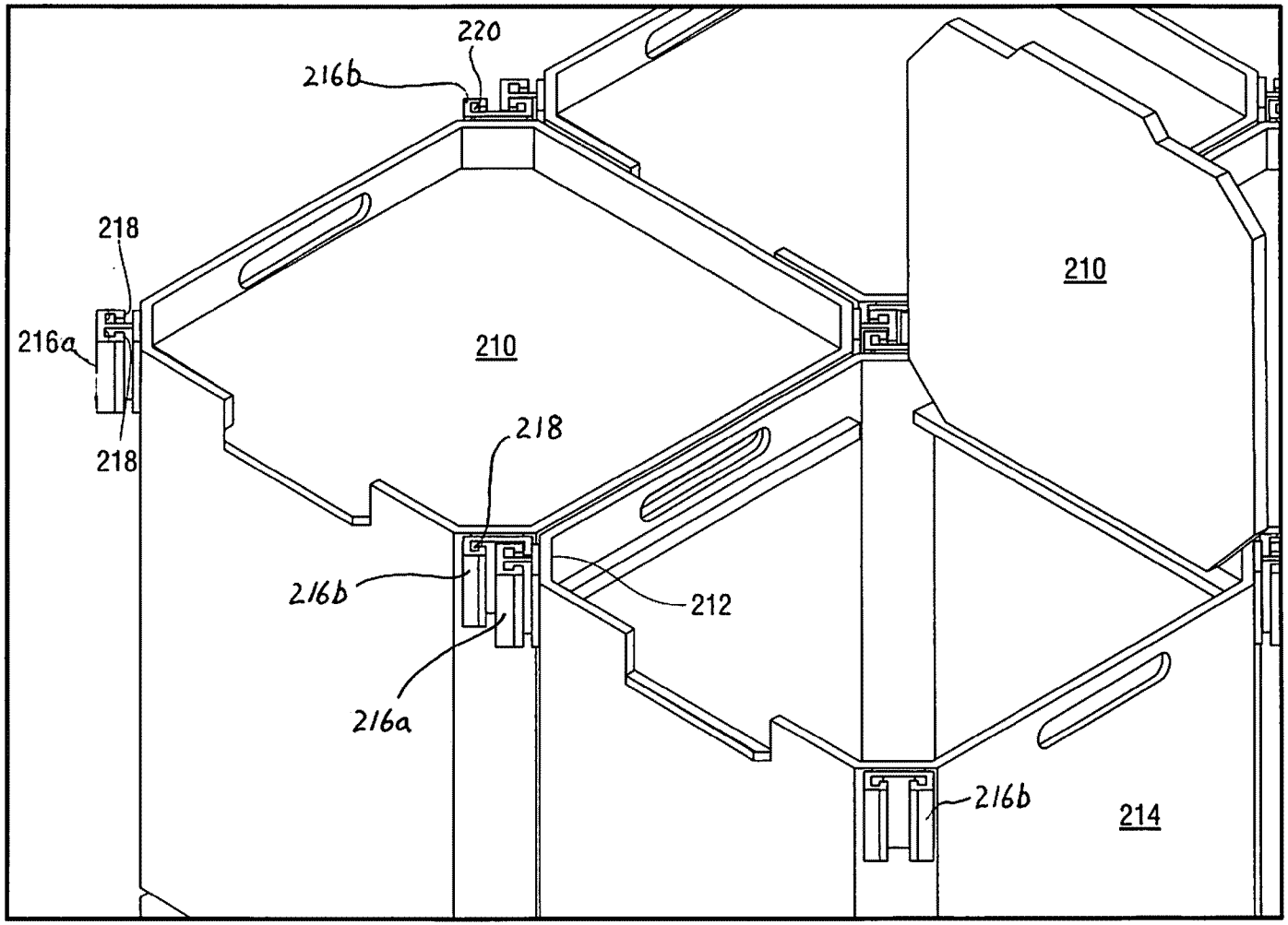
FIGS. 13-14 are top perspective views of the interlocked containers of the embodiment of FIGS. 11-12.

In the embodiment illustrated, the male and female runners 112, 114 include corresponding inclined locking surfaces 116, 118 which cooperate to secure the adjacent containers 102. The angle of inclination "x" of the inclined surfaces 116, 118 may range from about 15° to 80° relative to the axis of the wall (FIGS. 4 and 6). Decreasing the angle of inclination "x" increases surface area of the locking surfaces 116, 118 thereby increasing the interlocking capacity of the interlocking structure. In one embodiment, the angle of inclination is either about 15°, about 30° or about 45°.

The runners 112, 114 may be separate elements connected to respective end and side walls 104, 106, 108, 110 via known means or can be integrally formed with the walls. The runners 112, 114 may also extend beyond the upper surface of the container 102 to facilitate interlocking of the containers 102. The runners may be formed of wood or plastic.

In accordance with another feature of the present invention, each container 102 includes first and second pedestals 120 depending from its lower surface and a base 122 which is secured relative to the pedestals 120. The pedestals 120 are spaced a predetermined distance "k" relative to each other to define a gap or opening 124 to receive therebetween the blade 502 of the fork lift 500 (see also FIGS. 1 and 2) In addition, the pedestals are spaced a predetermined distance "b" (FIG. 5) from the side walls 108, 110 of the container 102 sufficient to receive the fork lift blade 502 when the containers 102 are placed in side by side relation as shown in FIG. 1. Any dimension "b" is envisioned with the understanding that the dimension "b" must be at least one half the width of the fork lift blade 502. The pedestals may also be spaced a predetermined distance "k" from the end walls 104, 106 of the container sufficient to receive the fork lift blade when the containers are placed in end to end relation.

The base 122 may include a length and width generally corresponding to the respective lengths and widths of the container 102 whereby the containers 102 when vertically stacked are stabilized. For example, FIGS. 2 and 8-10 illustrate a second arrangement of the containers 102 where the containers 102 are also vertically stacked. As shown, the interlocking structure associated with the end walls 104, 106 of the containers 102 are engaged in secured relation therewith such that the two rows of containers 102 are secured along their end walls 104, 106 and the side walls 108, 110. It is not necessary for the base 122 to extend the entire length and width of the container 102. For example, it is envisioned that the base may be one-half the length and/or width of the container. Other dimensions are also envisioned.

Referring now to FIGS. 11-14, an alternate embodiment of a container for use with the container system 200 is illustrated. Container system 200 includes a sophisticated rail/groove arrangement whereby the "rails" of one container 202 interlock with the "grooves" of an adjacent container. Thus, in the embodiment depicted in the FIGS. 11-14, each container 202 may be interlocked with three adjacent containers 202. Adjacent the bottom of each container is a foot or base incorporating a depending member 204 depending from the bottom of the container, which supports a base member 206. The base member 206 may be in general parallel relation with the bottom of the container 202. Defined between the bases 206 of adjacent containers 202 is a gap 208. The gap 208 is dimensioned to receive the fork of a fork lift utilized to transport, lift and/or separate stacked containers, i.e., a forklift blade can slide in between the two interlocking containers 202. Thus, due to the interlocking structure, the weight of at least four containers 202 can rest entirely on the one forklift blade. Accordingly, it is possible for a dual forklift, i.e., a forklift with two blades, to lift or transport 16 containers in one row. A plurality of rows of containers 202 can be vertically stacked thereby enabling a substantially large number of containers 202 to be lifted by the forklift. The forklift blades will align with the space between the interlocking containers 202 regardless.

The containers 202 may include a lid 210 which may be rectangular or square shaped which may enclose the container 202. The lid 210 may rest on the shelf 212 within the container and/or may snap fit into the container 202 for releasable securement thereof. Other means for releasably securing the lid are also envisioned including, e.g., a tolerance fit, latch mechanisms or the like.

Figure 14:
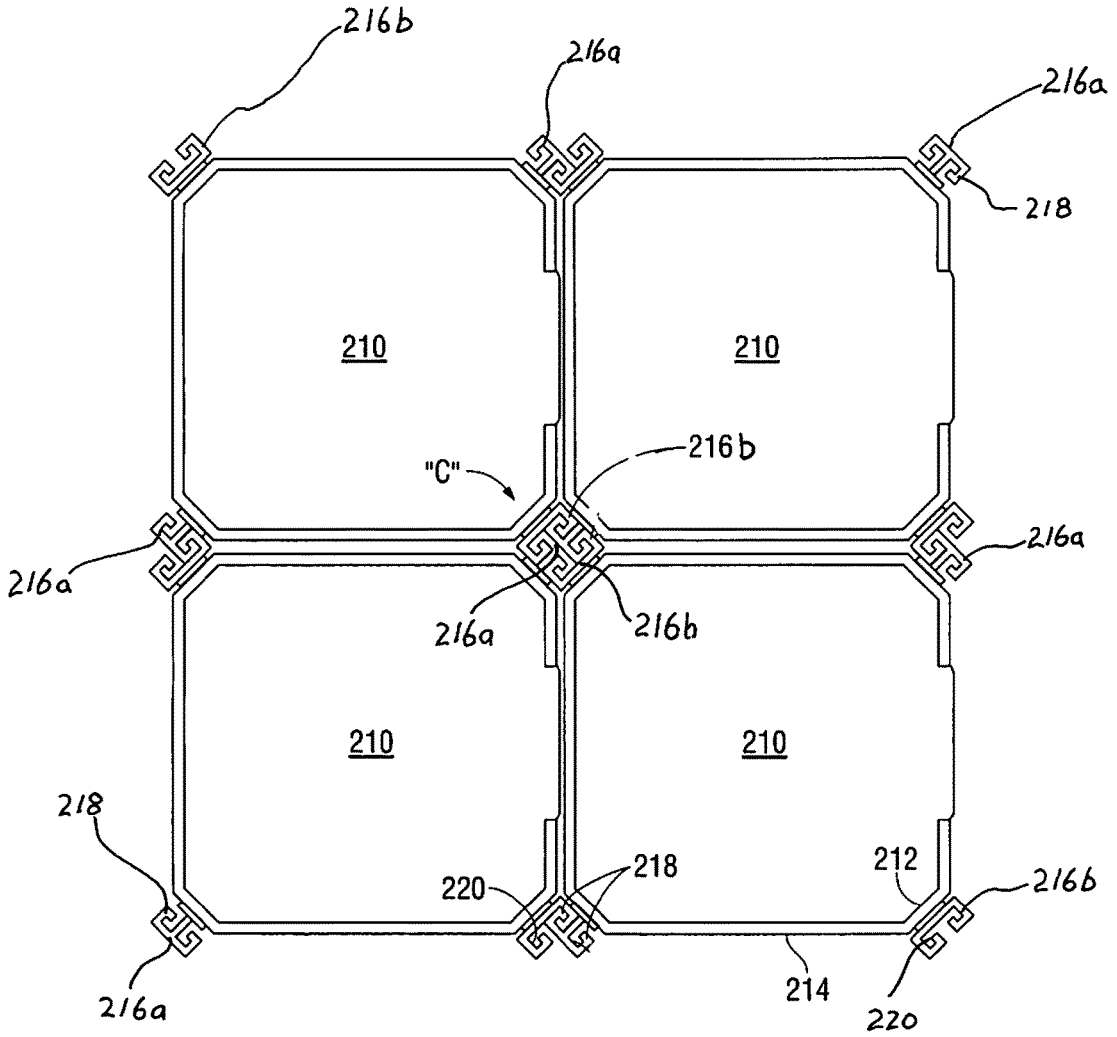

The containers 202 may include corner walls 212 interconnecting the main walls 214. The corner walls 212 include the interlocking structure, which, in one embodiment includes either a first or second runner **216*a*, 216*b* attached to the corner wall 212 or integrally formed therewith, and defining a rail and groove mechanism. Specifically, the first or male runner 216*a* has two opposed rails 218 and the second or female runner 216*b* two opposed grooves 220. The rails 218 of the first runners 216*a* are received (e.g., slidably) within corresponding grooves 220 of an adjacent container 202 of the second runners 216*b* to connect the components. As depicted in FIG. 14, the mechanism provides for a four way center interlocking arrangement "c" at the center of two rows of two side by side containers 202. This substantially stabilizes the plurality of adjacent containers 202 such that the containers 202 may be lifted by a single blade of the forklift. The corner walls 212 and interlocking structure are positioned and dimensioned to minimize the profile of the system such that the main walls 214 of adjacent containers 202 are in contacting relation when assembled thereby further stabilizing the system. The first runners 216***a* are disposed on diametrically opposed corner walls 212 of each container 202 and the second runners 216*b* are disposed on the remaining diametrically opposed corners 212 of the container 202.

Another example of interlocking structure for containers is disclosed in commonly owned U.S. Pat. No. 7,275,568 to Fredette, the entire contents of which are hereby incorporated herein by reference.

Figure 15A:
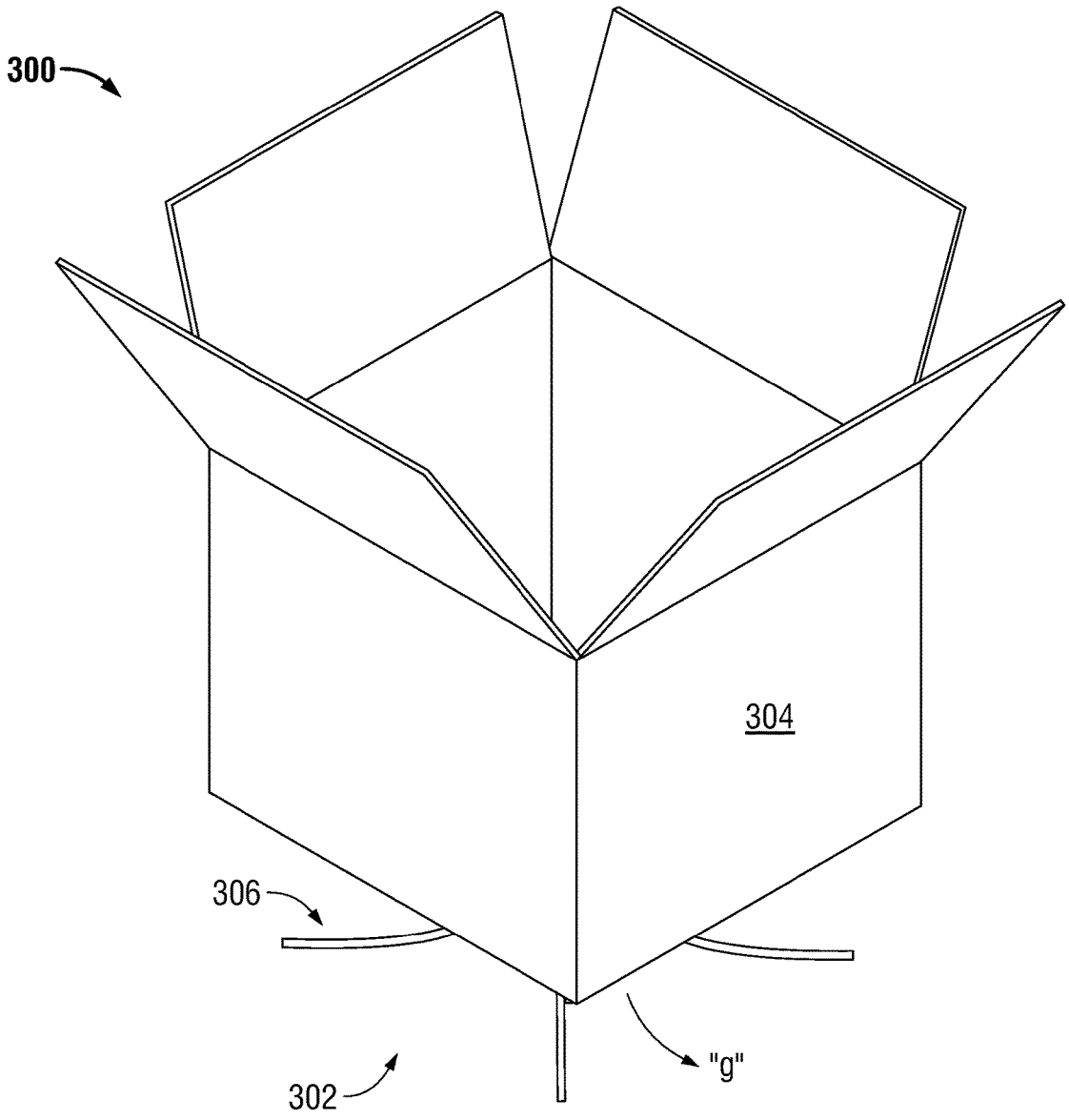
FIGS. 15A and 15B are perspective views of another embodiment of the container system incorporating a collapsible container.
Figure 15B:
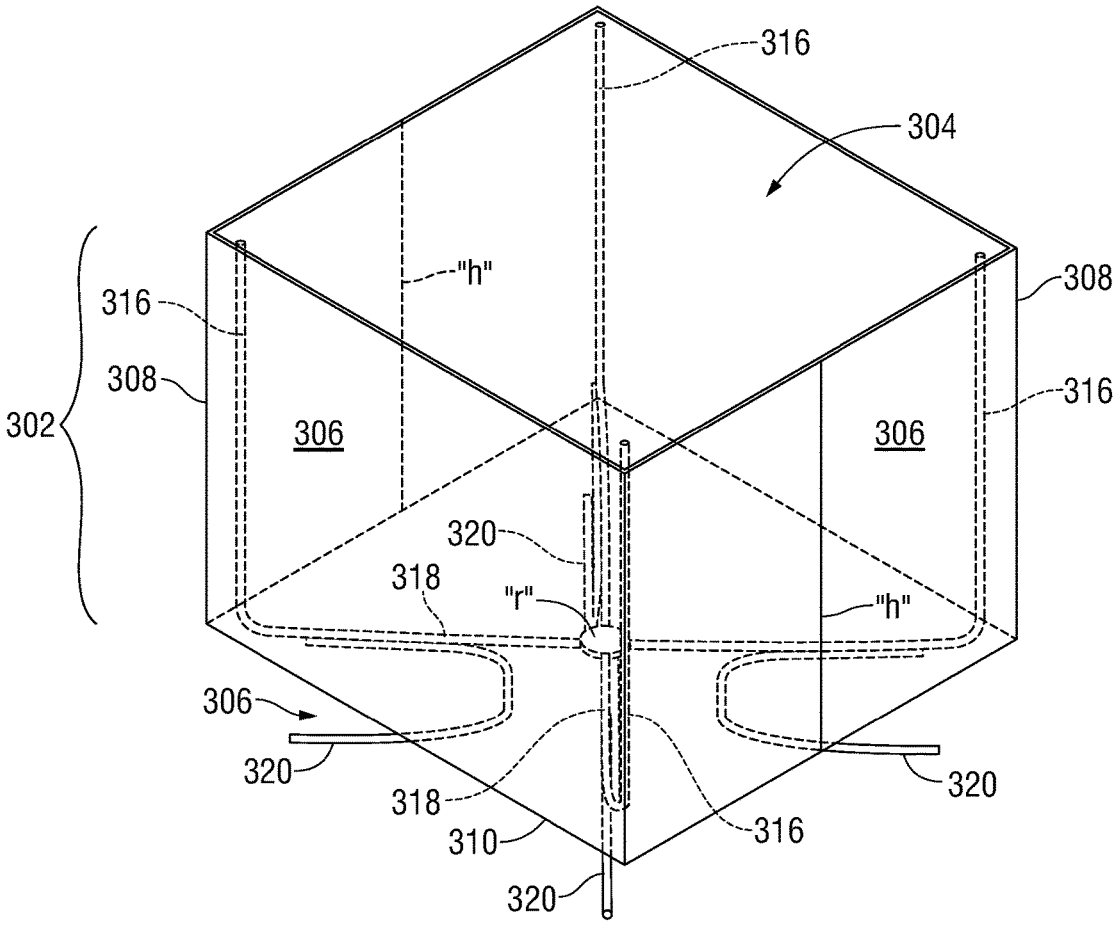
Figure 16:
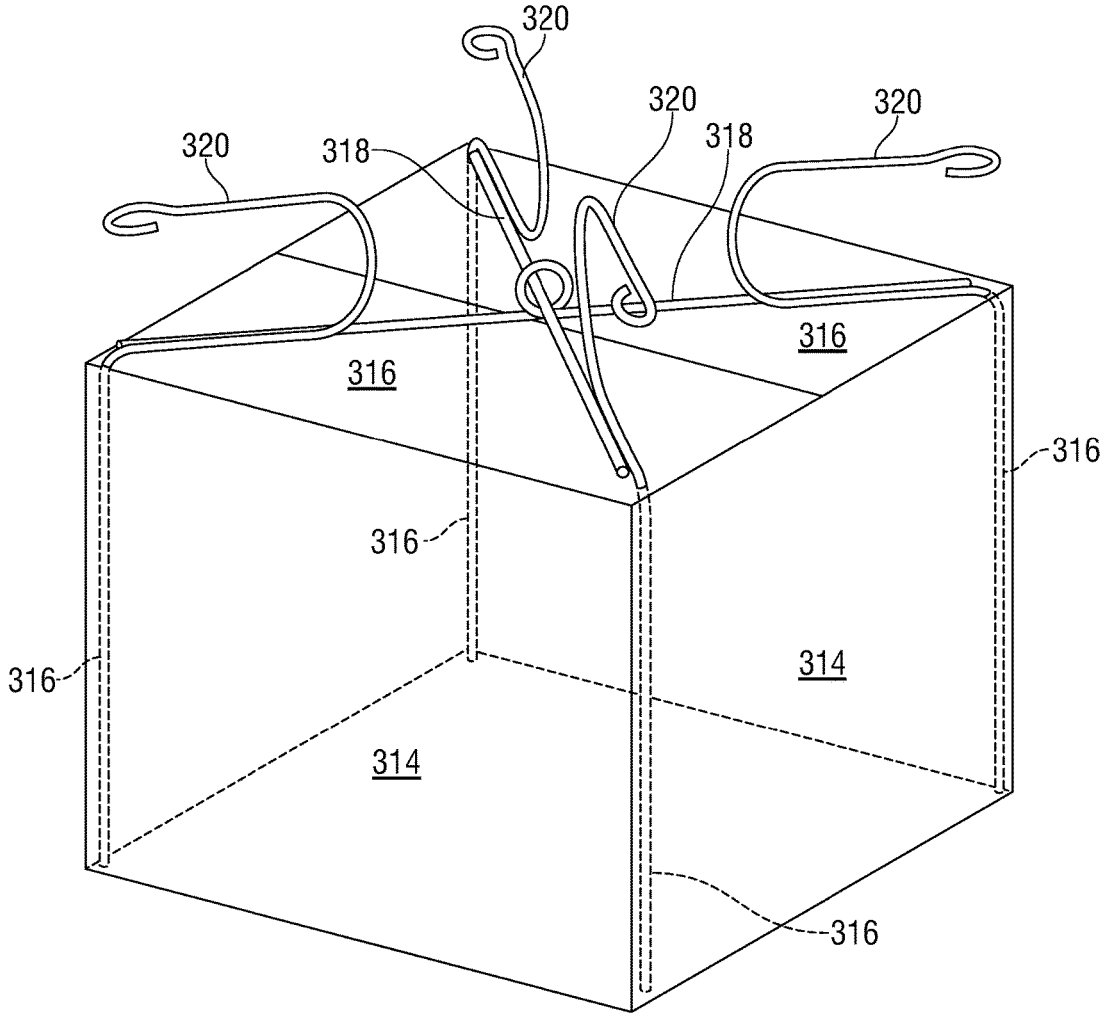
FIG. 16 is a perspective view illustrating the bottom section of the collapsible container.

Referring now to FIGS. 15A-15B and 16, a collapsible container system in accordance with an alternate embodiment of the present disclosure is illustrated. The collapsible container system 300 includes a plurality of collapsible containers 302 (one is shown in the drawings) which may include any of the interlocking structure discussed in connection with the prior embodiments. Collapsible container 302 includes container member 304 and a collapsible frame 305 mounted to the container member 304. The container member 304 may be a box or the like fabricated from cardboard, plastic or wood. The container member 304 includes at least three, e.g., four, side walls 306 with adjacent side walls 306 connected to each other along hinge lines 308 or any other means to foldably connect adjacent side walls 306 including hinge elements or the like. The container member 304 includes a bottom 310 which may include four walls 312 (FIG. 16) connected to respective side walls 306 along hinge lines 314. The container member 302 may also include a top which may be four individual panels or a single panel.

With reference to FIG. 15B and FIG. 16, the collapsible frame 305 may include vertical support segments 316 (shown in phantom in FIG. 15B), horizontal segments 318 (shown in phantom in FIG. 15B) which depend inwardly from the vertical support segments 316 and base segments 320. The vertical support segments 316 are embedded within, integral with or connected to the corners of the container member 304. The horizontal segments 318 may be connected via a joint 322 at the center of the container member 304. As discussed hereinbelow, the horizontal segments 318 pivot about this joint 322 to assume the collapsed condition. The base segments 320 depend beneath the container member 304 and collectively form a base which supports the container member 304 in a similar manner to the bases of the prior embodiments. The base segments 320 are also spaced to define a gap "g" (FIG. 15A) for reception of the blade of a forklift.

Figure 17:
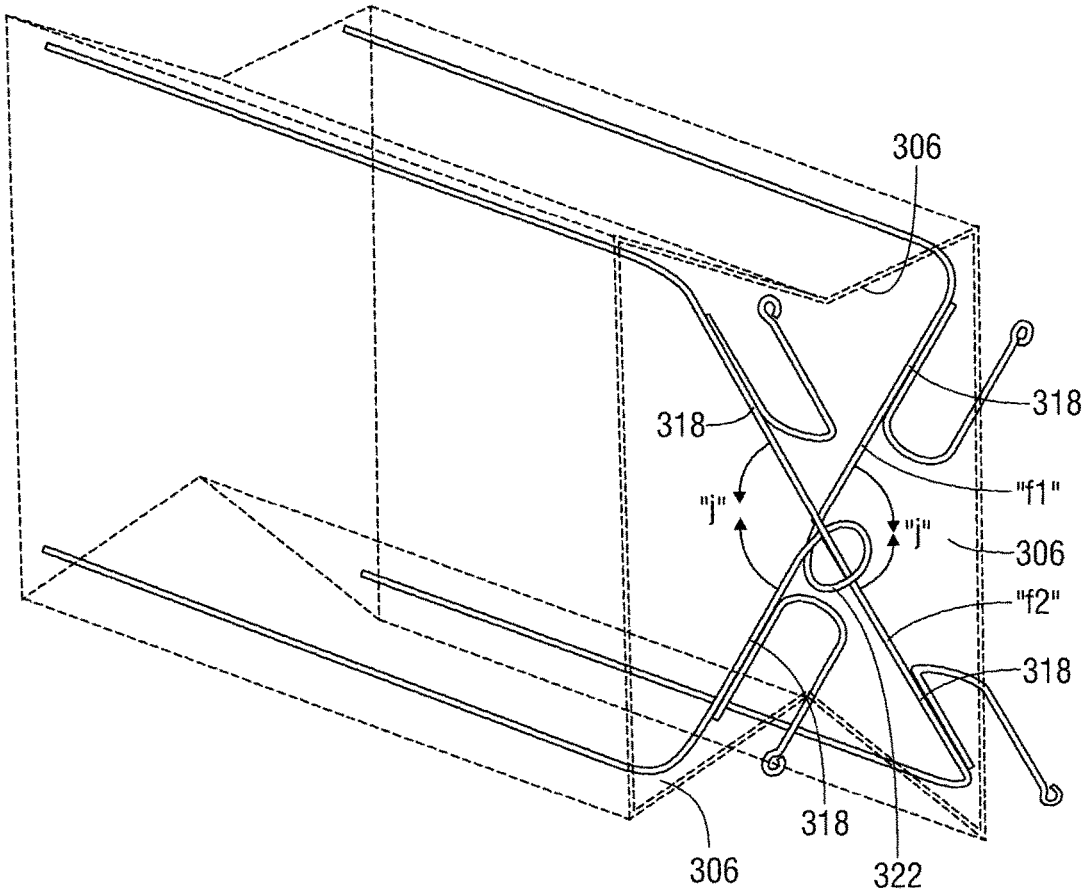
FIGS. 17-19 are views illustrating the steps undertaken to collapse the container.

With reference to FIG. 17, in one embodiment, the collapsible frame 306 may include two frame elements f1, f2 which extend from one corner to the opposed corner and encompass at least the vertical and horizontal segments 316, 318. The base segments 320 may be a component of the respective frame elements f1, f2. Alternatively, the base segments 320 may be separate from the other elements and secured to the container member 302 and/or the frame elements f1, f2 through conventional means. In an embodiment, one frame element f1 defines a looped segment 322 in the horizontal segment 318 thereof through which the other frame element f2, (its horizontal segment 318) extends. The looped segment 322 defines a pivot about which the frame elements f1, f2 may pivot to an approximated condition thereof. In another embodiment, the horizontal segments 318 are connected to one or more universal or rotary joints "r" (shown schematically in FIG. 15B) which permits pivoting movement of each of the four horizontal segments 318. An exemplary universal joint is disclosed in commonly assigned U.S. Pat. No. 4,493,675 to Wisthuff et al. and U.S. Pat. No. 4,654,922 to Chen, the entire contents of each disclosure being hereby incorporated herein by reference. The universal joints may include ratcheting mechanism to selectively control the pivoting movement of the horizontal segments 318.

The frame elements f1, f2 may be plastic, metallic or any other suitable material.

Figure 18:
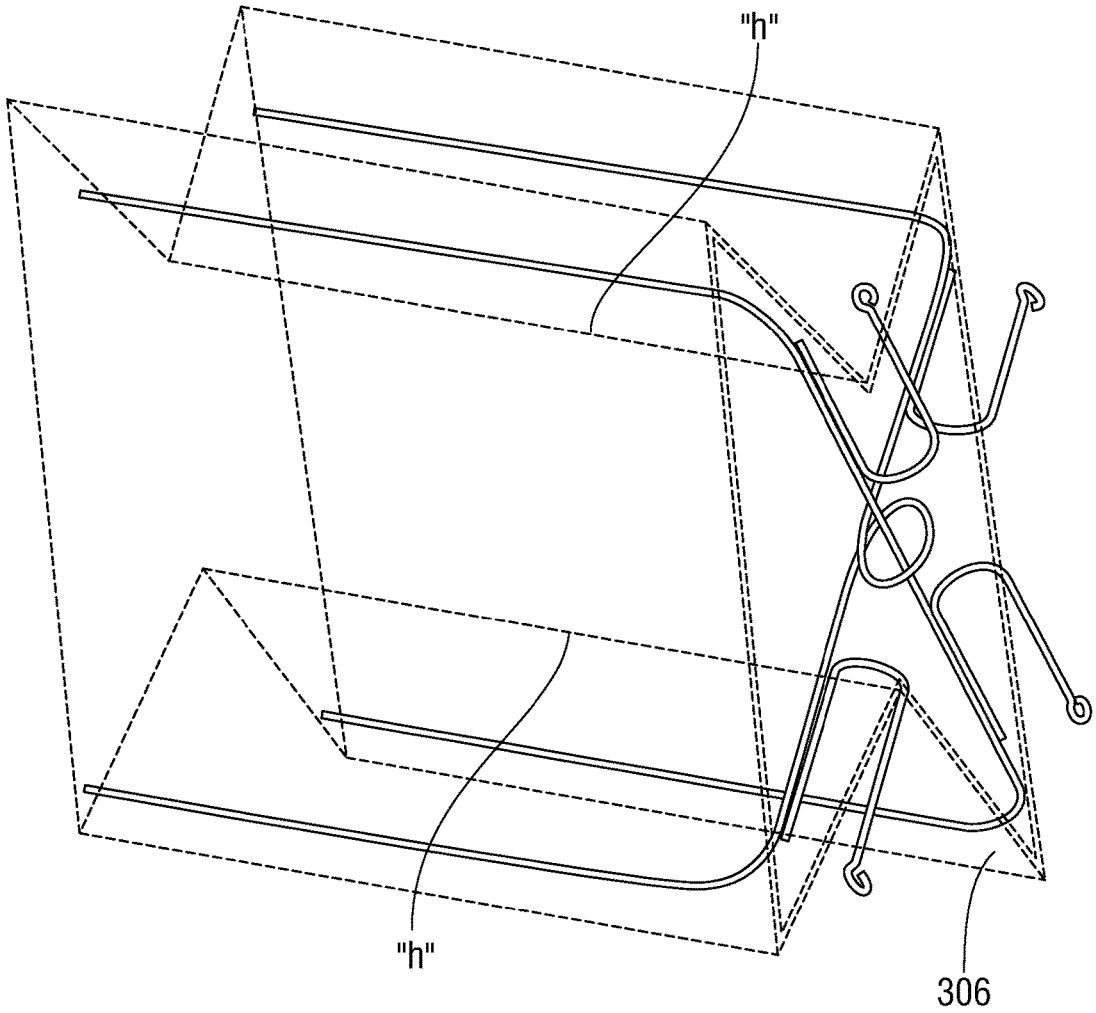
Figure 19:
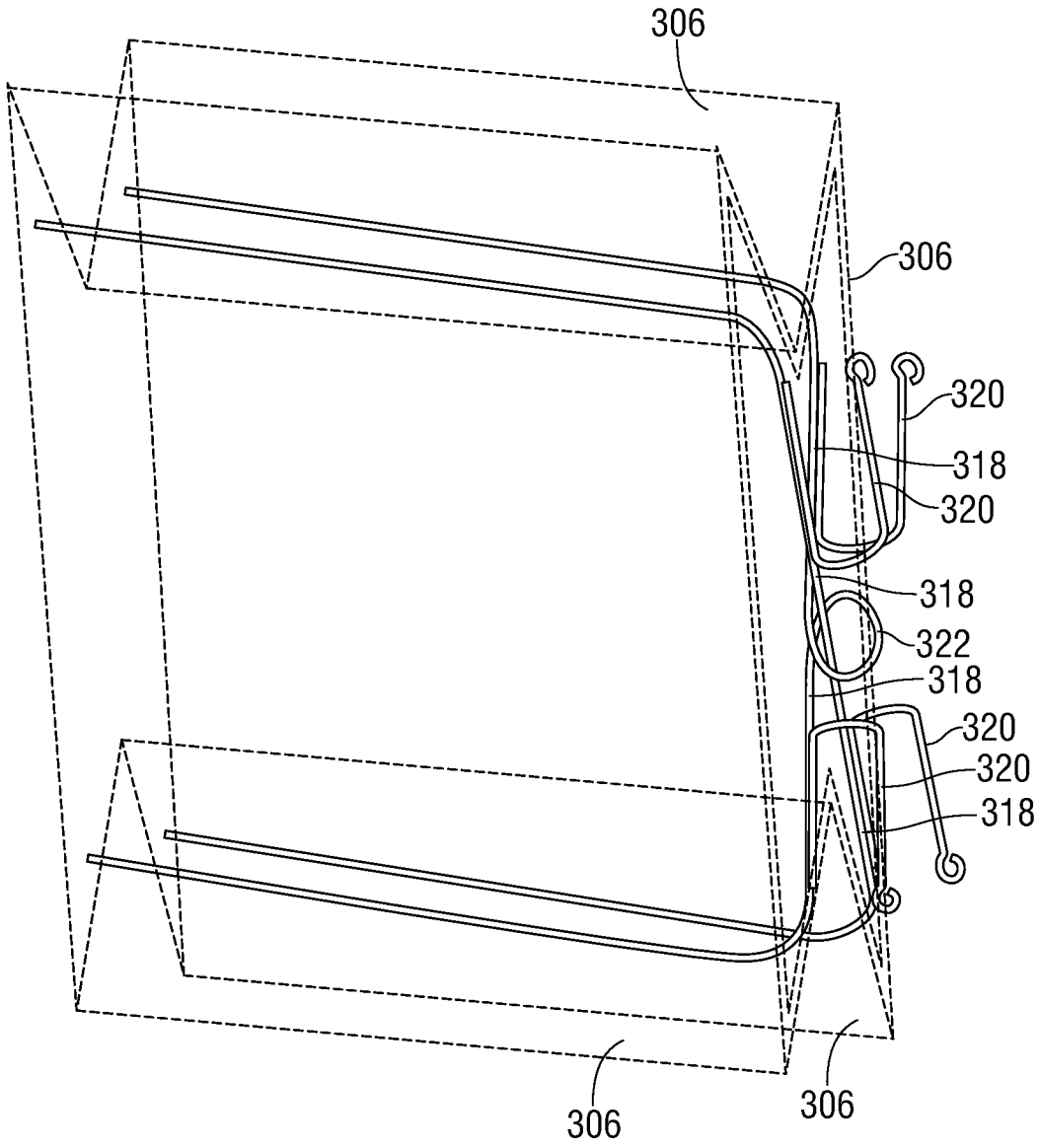

FIGS. 17-19 illustrate a preferred sequence of steps to move the container 302 from the open position to a closed position. With reference to FIG. 17, opposed horizontal segments are move toward each other in the direction of directional arrows "j" whereby the side panels 306 pivot about hinge line "h" (see also FIG. 15B) which extends to subdivide the side panels as best shown in FIG. 18. The horizontal segments 318 are further moved toward each other in approximated relation resulting in the closed container 302 of FIG. 19. With this folded arrangement or collapsible capability, a multitude of containers 302 can be stored in stacked relation, thereby minimizing storage space which would otherwise be used for standard non-collapsible containers.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A container system for use with a forklift, which comprises:

four containers for storing goods, each container defining an x-axis, a y-axis and a z-axis corresponding to a length, width and depth, respectively, of each container, each container including interlocking structure, the interlocking structure including a male runner disposed on each of a first and a third container and a female runner disposed on each of a second and a fourth container, the male runners of the first and third containers dimensioned and arranged to interlock with the female runners of the second and fourth containers in coupling relation therewith to securely couple and interlock the first, second, third and fourth containers to each other to substantially prevent relative lateral movement of each of the four containers with respect to each other and to substantially prevent relative rotational movement of the four containers about each of the axes and with respect to each other; and each male runner including a single continuous rail having first and second opposed rail segments and wherein each female runner includes a single continuous groove having first and second opposed groove segments, the first rail segments of the male runners of the first and third containers being respectively received within the first groove segments of the second and fourth containers, and the second rail segments of the male runners of the first and third containers being respectively received within the second groove segments of the second and fourth containers, wherein each container includes a corner wall interconnecting adjacent side and end walls, the corner wall of each of the first and third containers having male runners, the corner wall of each of the second and fourth containers having female runners.

2. The container system according to claim 1 wherein each container includes male runners disposed on diametrical opposed corner walls and female runners disposed on diametrical opposed corner walls.

3. The container system according to claim 1 wherein each container includes male runners disposed at diametrical opposed corners and female runners disposed at diametrical opposed corners, each male runner including the single continuous rail having the first and second opposed rail segments and wherein each female runner includes the single continuous groove having the first and second opposed groove segments.

4. The container system according to claim 3 including a base secured relative to each container, the base dimensioned to support the container and being adapted to couple with the blade of the forklift to permit placement and transport of the containers in an interlocked relation thereof.

5. The container system according to claim 4 includes a single pedestal member depending from the base and a base member coupled to the pedestal member, the pedestals being dimensioned such that a gap is defined between adjacent coupled containers, the gap for receiving a blade of a forklift.

* * * * *